US007578252B1

(12) United States Patent
Urbanek

(10) Patent No.: US 7,578,252 B1
(45) Date of Patent: Aug. 25, 2009

(54) INFLATABLE WHISKER POLE

(75) Inventor: Paul Urbanek, 153 School St., Concord, NH (US) 03301-2562

(73) Assignee: Paul Urbanek, Concord, NH (US)

( * ) Notice: Subject to any disclaimer, the term of this patent is extended or adjusted under 35 U.S.C. 154(b) by 0 days.

(21) Appl. No.: 12/034,208

(22) Filed: Feb. 20, 2008

(51) Int. Cl.
*B63H 9/04* (2006.01)

(52) U.S. Cl. ..... 114/97; 114/102.1; 114/102.28

(58) Field of Classification Search ..... 114/102.1, 114/97, 102.28
See application file for complete search history.

(56) References Cited

U.S. PATENT DOCUMENTS 4,539,927 A * 9/1985 Foresman ..... 114/89
4,573,933 A * 3/1986 Cameron ..... 441/16
4,879,961 A 11/1989 Aguilera
5,279,241 A 1/1994 Aguilera
5,333,569 A 8/1994 Henderson
5,347,946 A 9/1994 Puckett
5,603,277 A * 2/1997 Webb ..... 114/39.25
6,551,215 B1 * 4/2003 Gordon ..... 482/35
2001/0037756 A1 11/2001 Fink
2002/0100406 A1 8/2002 Costa, Jr. et al.
2002/0139284 A1 * 10/2002 Iacoboni ..... 114/90

* cited by examiner

*Primary Examiner*—Stephen Avila
(74) *Attorney, Agent, or Firm*—Grossman Tucker Perreault & Pfleger PLLC

(57) ABSTRACT

A whisker pole for a sailboat is provided. The whisker pole includes an inflatable portion that can be pressurized to maintain the position of a headsail. The whisker pole can be deflated for stowage. The length of the whisker pole can be adjusted for different boats and rigging requirements.

10 Claims, 7 Drawing Sheets

INFLATABLE WHISKER POLE

BACKGROUND

1. Field of Invention

The invention relates to sailboat accessories and, in particular, to a whisker pole for a sailboat.

2. Discussion of Related Art

Sailing often requires the placement of one or more sails in a particular formation in order to obtain maximum power from the sail. When a boat is running with the wind it is often desirable to fully extend a headsail to one side of the boat or the other so that the sail surface is normal to the wind direction. On this heading, the sail functions less as an airfoil and more as a parachute, simple catching the wind and transferring its force to the boat. When held in position only by the left or right jib sheet, it can be difficult to keep the headsail taught and full. It tends to flap back and forth providing for a noisy, inefficient, and potentially dangerous cruise.

A whisker pole can be used to keep the tailing corner of the headsail (clew) as far from the midline of the hull as is practical. Whisker poles have traditionally been made of wood, aluminum and carbon fiber. One end of the pole is attached to the mast and a second end is attached to the jib sheet, adjacent the clew of the headsail. In this manner, the headsail is kept at full extension allowing it to capture wind without excessive flapping. When the boat tacks, the whisker pole is removed and reattached on the opposite side. A whisker pole may be most advantageous when the boat is running directly downwind and the captain wishes to sail "wing and wing" with the mainsail fully extended on one side and the headsail fully extended on the other.

SUMMARY OF INVENTION

The subject matter of this application may involve, in some cases, interrelated products, alternative solutions to a particular problem, and/or a plurality of different uses of a single system or article.

In one aspect, a whisker pole for a sailboat is provided, the whisker pole comprising at least one elongate inflatable body.

In another aspect, a method of making a whisker pole is provided, the method comprising the steps of affixing a connector to a first end of an inflatable body, the connector constructed and arranged to attach removeably to a headsail or headsail sheet, and affixing a second connector to the second end of the inflatable body, the second connector constructed and arranged to secure the whisker pole to the mast or other area that is stationary with respect to the boat hull.

In another aspect a method of installing a whisker pole on a sailboat is provided, the method comprising inflating the whisker pole, attaching a first end of the whisker pole to a headsail or a headsail sheet, and securing a second end of the whisker pole in a position stationary with respect to the boat hull.

DETAILED DESCRIPTION

Figure 1:
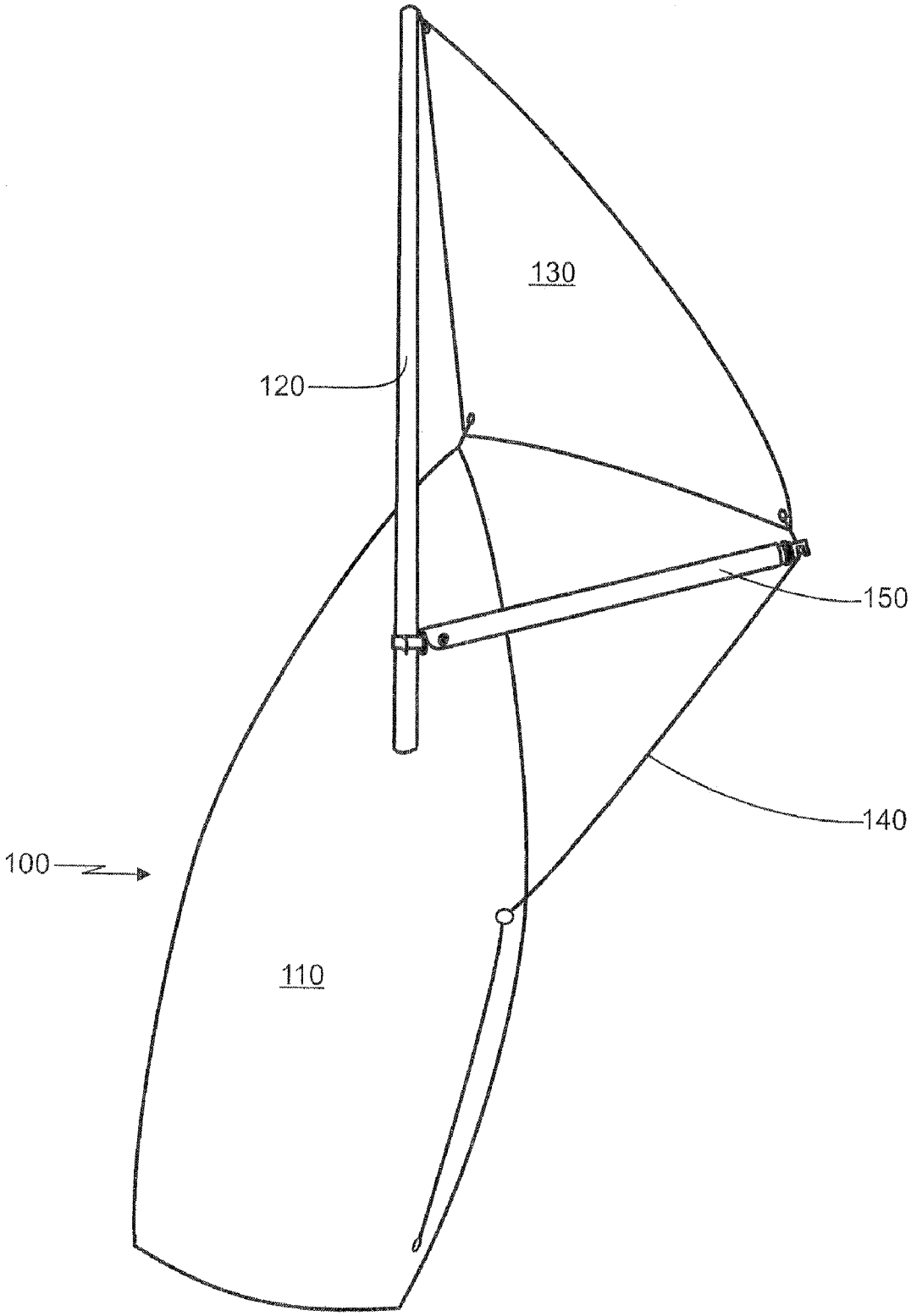
FIG. 1 is a perspective view of a sail boat with a whisker pole.

Conventional whisker poles are typically made of aluminum, fiberglass, carbon, or other unbendable material and need to be stored in places that can accept a large pole. Some whisker poles are collapsible but are still 8 or 10 feet long even when fully collapsed. Often these conventional poles are stored on deck where they need to be secured, and they can become a hindrance to those moving about the deck. If one end of the pole should become unattached during use it can be flung violently around the deck posing a hazard to those nearby. These conventional whisker poles are dense enough that if lost overboard they sink or at least are very difficult to recover.

In one aspect, a whisker pole is provided wherein at least a portion of the whisker pole can be inflated. When not in use, the whisker pole can be deflated for compact storage or shipping. Although one might believe that an inflatable pole could not provide adequate rigidity to maintain the position of a headsail, it has been found that the strength of the pole, and specifically the compression strength of the pole, is more than sufficient for retaining the headsail in its extended position. The whisker pole may include connectors at each end allowing the pole to be attached to a jib sheet and to the mast. These connectors may be the same or similar to connectors used with conventional whisker poles. In some embodiments the whisker pole can be inflated to different lengths. The inflatable portion of the whisker pole may be made of any inflatable material suitable for a marine environment. For instance, the pole may be made out of sheets of PVC coated polyurethane or neoprene-coated nylon. Other suitable materials include, for example, airtight wovens and nonwovens such as coated polyaramid fiber fabric, PVC, coated polyester or nylon. Fabric sheets may be formed into tubes with sealed seams using methods known to those skilled in the art. Tubes may include radar reflective material such as metallized polyester. If lost overboard, the inflatable whisker pole can float and may be made of brightly colored material to facilitate recovery. The pole may be made of one or more tubes. Multiple tubes may be configured, for instance, end to end, in a truss structure, coaxially, or along side each other. The tubes may be of different lengths and thicknesses, and although the diameter may vary, the tubes are usually of consistent diameter along their length. In embodiments where the diameter of the tube varies along its length, the shape of the tube may be irregular with alternating thick and thin sections or may be a regular shape, such as ovoid. In cross section, the tubes may be of any functional shape, including round, ovoid, I-beam, triangular, square and polygonal. Total inflated length of the whisker pole may be, for example, greater than or equal to 8 feet, greater than or equal to 12 feet, greater than or equal to 15 feet or greater than or equal to 20 feet. In some embodiments the pole inflates to a fixed length. In other embodiments the length of the pole is variable. The pole length may be infinitely variable within a particular range of use. The pole may be inflated with any compatible gas such as air, carbon dioxide or nitrogen, and the gas may be provided by, for example, a manual or powered pump or by a compressed gas container. The pole may be inflated to a pressure that provides adequate rigidity for its use as a whisker pole. Depending on the specific application, appropriate pressures may be, for example, greater than atmospheric, greater than 2 psi, greater than 5 psi, greater than 10 psi or greater than 15 psi. When installed, the whisker pole is generally in a state of compression, keeping the jib sheet extended away from the mast when the tendency of the jib and jib sheet is to move inwardly, toward the hull and mast. It has been found that the inflatable pole exhibits adequate resistance in this direction.

FIG. 1 provides a perspective view of a sailboat running before the wind using a whisker pole. For clarity, the mainsail is not shown. Sailboat 100 includes hull 110 and mast 120. Headsail (jib) 130 is flown forward of mast 120 and is trimmed using jib sheet 140. Inflatable whisker pole 150 is removeably attached to mast 120 as well as to jib sheet 140. It is positioned to retain headsail 130 in the position shown.

Figure 2:
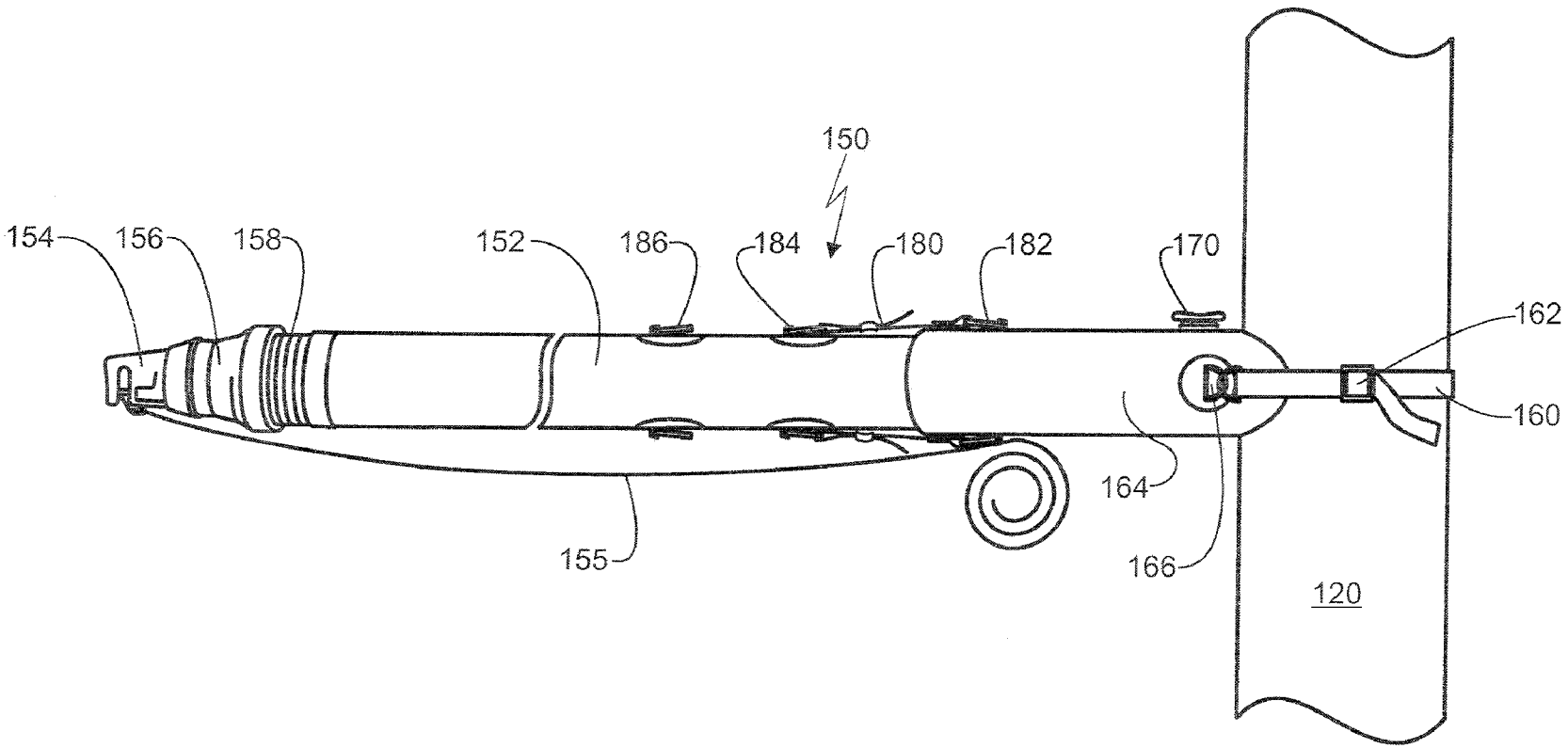
FIG. 2 is a side view of one embodiment of a whisker pole.

FIG. 2 provides a side view of one embodiment of the inflatable whisker pole 150 shown in FIG. 1. Whisker pole 150 includes inflatable tube 152 made of PVC coated polyurethane. Inflated diameter of tube 152 is about 5 inches although various diameters may be used. The diameter of the whisker pole may be, for example, greater than one inch, greater than 2 inches, greater than 3 inches, greater than 5 inches, greater than 8 inches or greater than 10 inches. The inflatable tube can be inflated and deflated through valve 170. Appropriate valves are known to those skilled in the art and include, for example, Halkey valves.

Connector 154 may be any device that can secure the distal (farthest from the mast) end of whisker pole 150 to the headsail or sheet. It may be, for example, a clip, latch, strap or carabiner. In some embodiments, connector 154 may be a piston or latch style end fitting such as the end fitting on a Forespar Ultra Whisker Pole (3.5 inch diameter). The connector may be spring loaded in the closed position and can be opened by pulling line 155. Once line 155 is released, connector 154 returns to a closed position. Connector 154 is attached to cap 156 which is joined to inflatable tube 152 by collar 158. In the embodiment shown, cap 156 is threaded to collar 158 and provides an airtight seal.

Connector 160 is attached to end cap 164 at the proximal (nearest the mast) end of whisker pole 152 by clasp 166. Buckle 162 can be tightened to secure connector strap 160 to mast 120 or to some other point, such as a rail or bow sprit, that is stationary with respect to the boat hull. In other embodiments various types of fasteners can be used, including snaps, zippers, hook & loop fasteners, buckles and knots, for example. End cap 164 may be of rigid material such as polymer or aluminum. The cap may be molded or machined and in some embodiments is made of PVC. Valve 170 may be mounted in an orifice in cap 164 and can provide fluid communication between tube 152 and a pressurized gas source such as a foot pump or compressor. In some embodiments, whisker pole 150 may be designed to rotate around mast 120. The mast may also be fitted with a connector that allows the whisker pole to be quickly clipped and unclipped from the mast without having to fully encircle the mast. On some boats, the connector may be designed to avoid interference with rigging such as halyards that may run alongside the mast.

Figure 3:
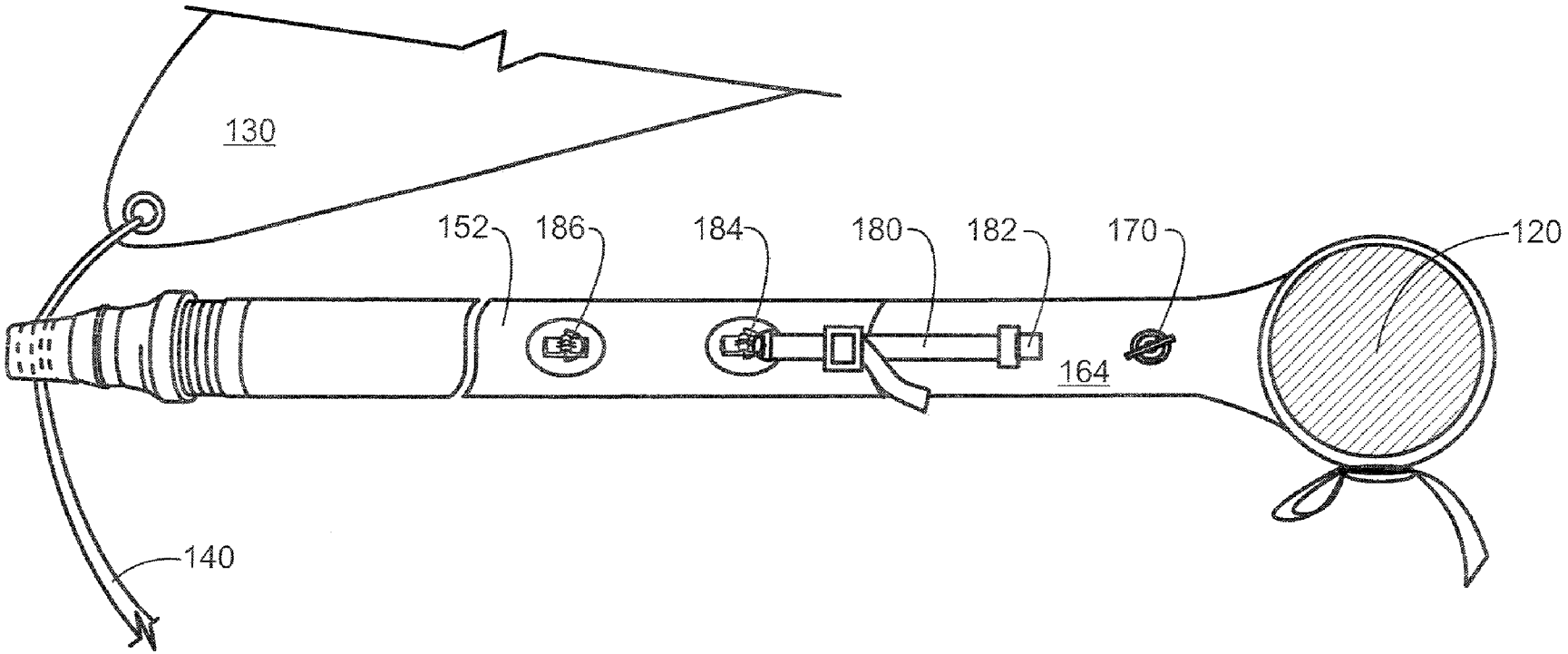
FIG. 3 is a top view of the embodiment shown in FIG. 2.

One or more cleats 182, 184 and 186 may be included on the whisker pole. Cleat 182 is mounted to end cap 164 while cleats 184 and 186 are attached to inflatable tube 152. Strap 180 can be lengthened or shortened to provide for a variable length whisker pole. FIG. 3 provides a top view of the whisker pole of FIG. 2 and provides a plan view of strap 180, cleats 182, 184 and 186 as well as valve 170.

Figure 4:
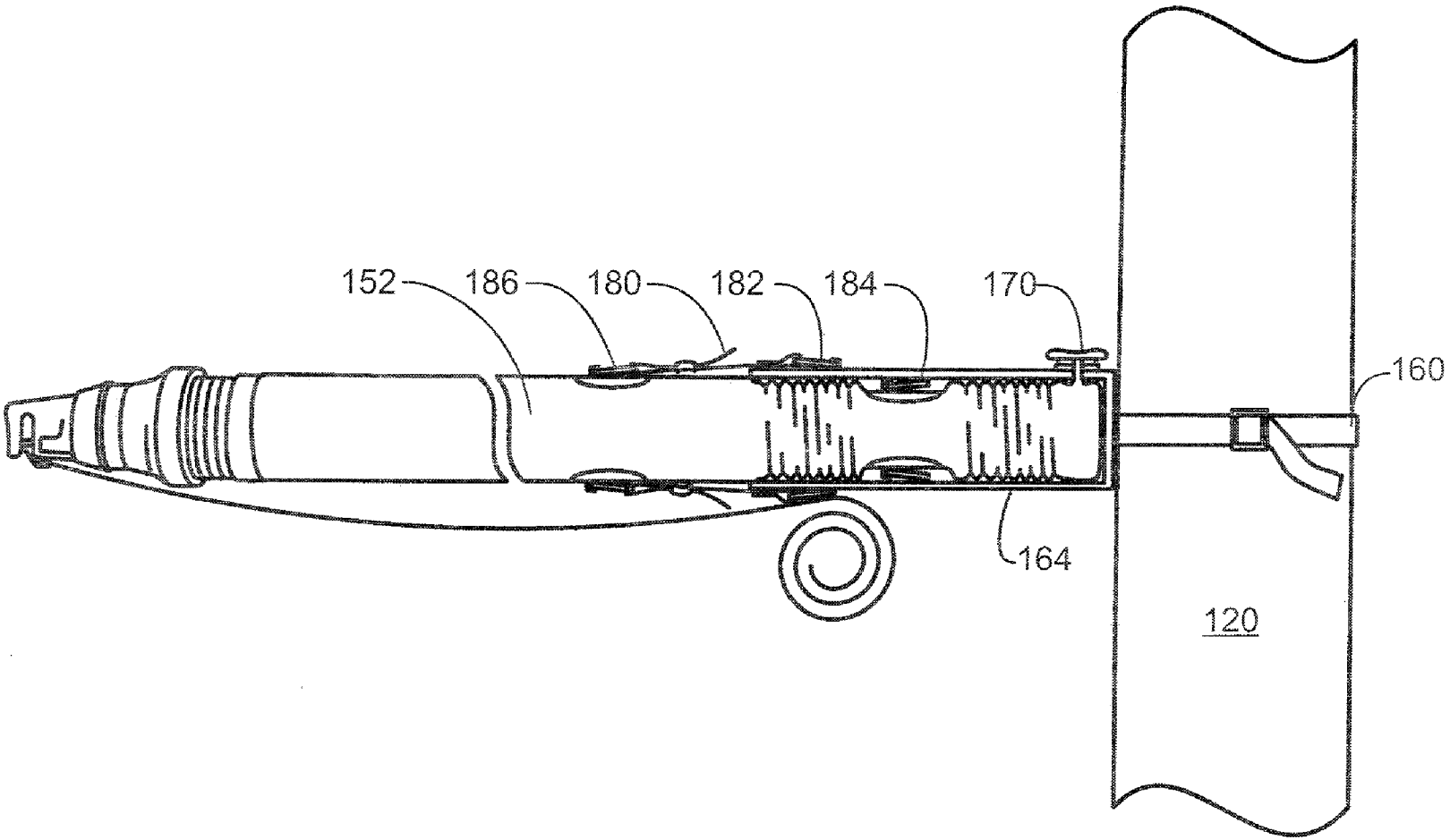
FIG. 4 is a cutaway side view of an embodiment showing a compressed whisker pole.

In FIG. 4, the pole is shown in a compressed, shortened configuration. A portion of inflatable tube 152 has been compressed inside of end cap 164. End cap 164 can provide rigidity for the portion of tube 152 that is not fully expanded and is retained inside the end cap. Cleat 184, which was positioned distally of cap 164 in FIG. 2, is now shown tucked into end cap 164 due to the shortening of the tube. Strap 180 secures cleat 182 to cleat 186 and prevents the tube from expanding out of end cap 164 when tube 152 is pressurized. In some cases, strap 180 (and the opposing strap on the opposite side of the pole) is tightened prior to inflating tube 152. In other cases, the tube can be inflated, or partially inflated, with final compression being provided by tightening the strap or straps. Indicia may be included on tube 152 to show what the inflated length of the pole will be. For instance, a series of lines on tube 152 may be associated with numbers that indicate the final length of the tube when a given line is aligned with the distal end of end cap 164. Using these indicia, a sailor can align a labeled mark, e.g., 18'6", with a fixed position such as the distal edge of end cap 164. Sizing strap 180 can then be affixed to cleats 182 and 186 so that the length of tube 152 is fixed. The tube can then be fully inflated to operational pressure and will obtain a total length of 18'6" without additional adjustment.

Figure 5:
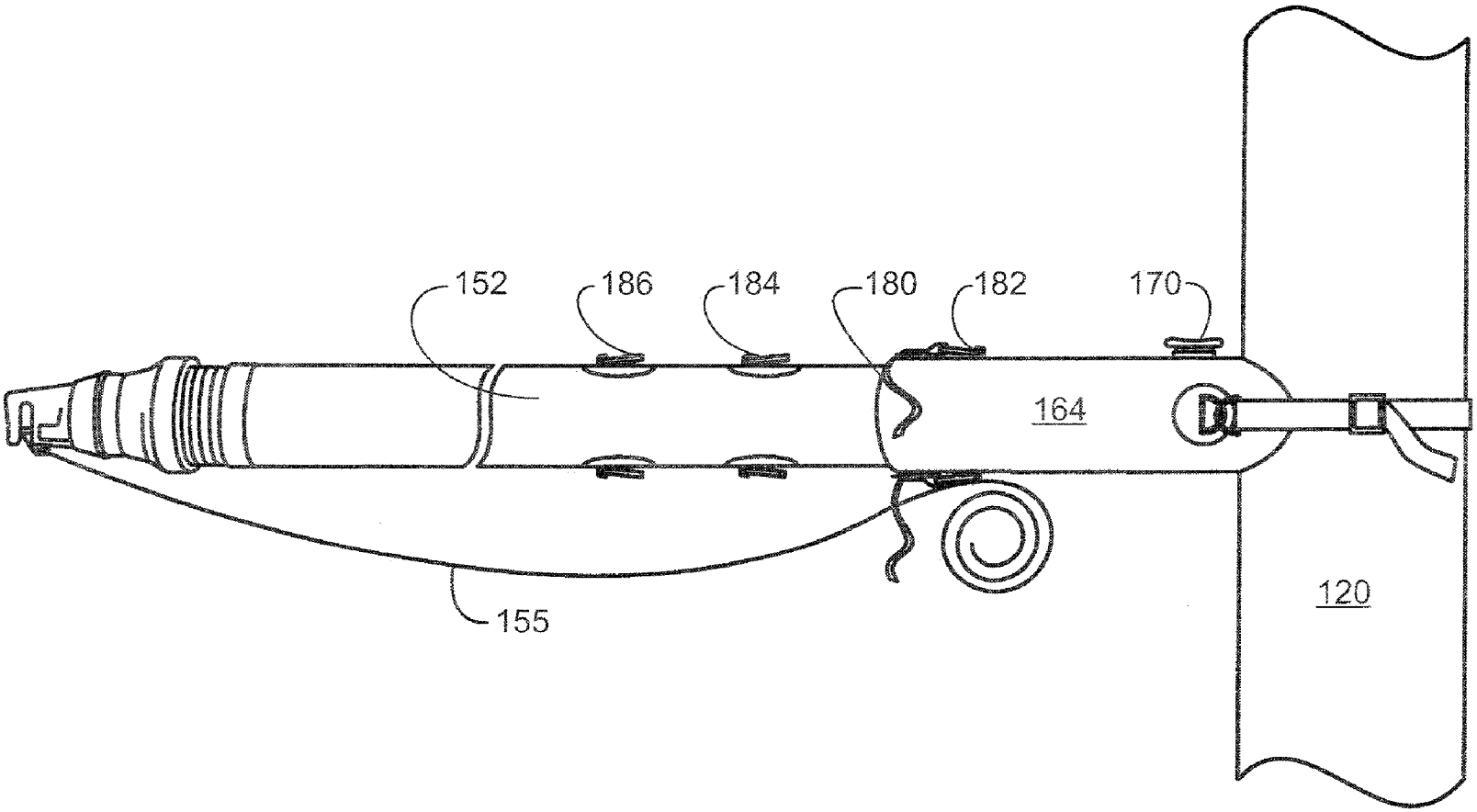
FIG. 5 is a side view of the embodiment of FIG. 4 in a fully extended configuration.

FIG. 5 provides a side view of the whisker pole of FIG. 2 in a fully expanded position. In this "maximum length" configuration, tube 152 can be fully inflated without being constrained by strap 180. A sailor may choose to use a tube of fixed length designed to match a specific rigging configuration without concern for any length adjustment. In some embodiments the whisker pole can be provided without adjustment features such as strap 180 and cleats 182, 185 and 186.

Figure 6:
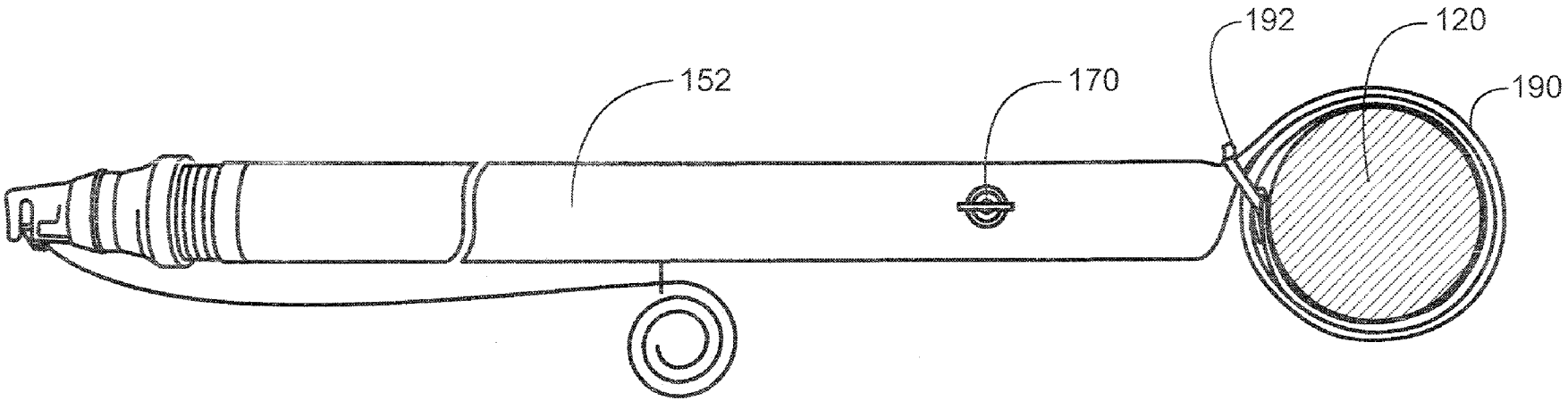
FIG. 6 is a top view of another embodiment of a whisker pole.

FIG. 6 provides a top view of another embodiment. In this embodiment, no end cap is required and the tube itself is secured to the mast by wrapping the end portion 190 of tube 152 around the mast and securing the tube to itself or to a fastener 192 on the mast, such as a buckle or hook & loop fastener. After fastening, the tube is prevented from unwrapping when in it is pressurized and put in service. The inflated length of the whisker pole can be controlled by the amount of tube 152 that is wrapped around the mast. A shorter tube means additional wrapping around the mast in order to reduce the inflated length of the tube. Depending on the circumference of a specific mast, the amount of wrapping can be correlated to a final length of the whisker pole. For instance, in one embodiment, a 360 degree wrap may produce a 16 foot pole while a 540 degree wrap may produce a 15 foot pole. Indicia on tube 152 can be aligned with fastener 192, or some other point, in order to arrive at a predetermined inflated length. The tube may be uninflated or partially inflated prior to wrapping. After wrapping is completed and the tube is secured it can be inflated to full rigidity.

One set of embodiments can use more than one inflatable tube. For instance, multiple tubes can be joined together axially end-to-end using rigid connectors similar to end cap 164 except that the connector may be open on both ends to receive tubes from both sides. In this manner, different length poles can be constructed by adding or subtracting modular sections. Sections may be joined together using straps and cleats similar to those shown in FIG. 2. These sections can be sized to that they can function as boat fenders when not being used as components of the whisker pole.

Multiple tubes may also be used together in arrangements in which a plurality of tubes run parallel to each other or in which two or more tubes are arranged coaxially. Multiple tubes may be isolated form each other and inflated separately or may be in fluid communication with each other so that they may be filled and drained via a common valve.

Figure 7:
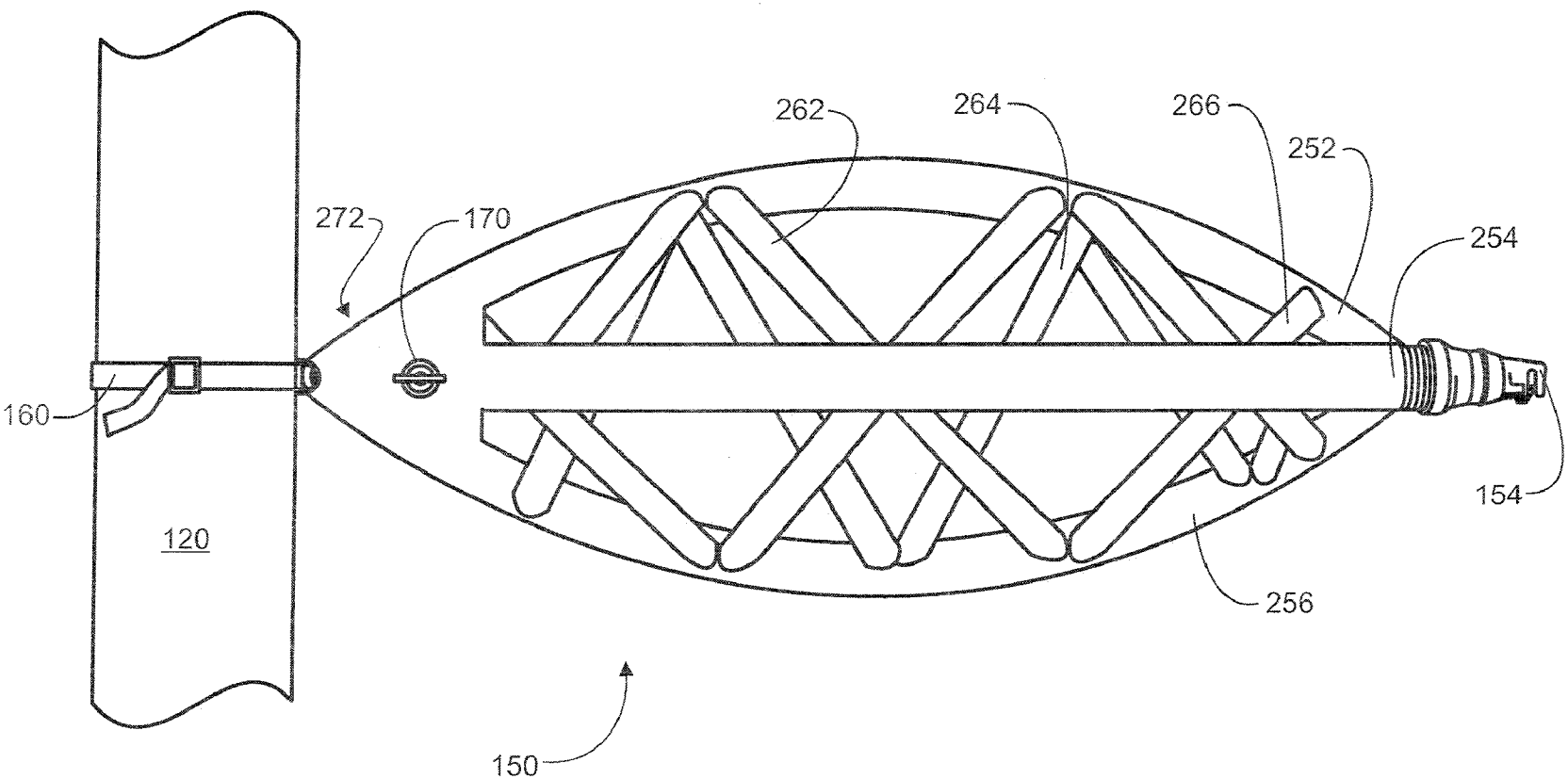
FIG. 7 is a side view of a truss-type embodiment of a whisker pole.

FIG. 7 illustrates an embodiment of a whisker pole that uses multiple tubes to form a truss. Two, three, four or more tubes may be joined together in a truss to provide enhanced rigidity and compression strength while maintaining collapsibility. As illustrated, inflatable tubes 252, 254, 256 and 258 can be joined together at each end and can bow outwardly in the middle portion of the truss. The tubes are restrained from further outward expansion by cross pieces 262, 264, 266 etc. These cross pieces may be inflatable or uninflatable. They may be constructed of similar or identical materials as tubes 252, 254, 256 and 258 and may be in fluid communication with these tubes. In other embodiments they may be constructed from rope, cord, straps or shock cord. The bowed tubes may also be retained by an egg-shaped net that surrounds the tubes and prevents them from expanding beyond the dimensions of the net. The truss may be inflated through one or more inflation/deflation valves 170 which may supply pressurized gas to each of the tubes through manifold 272. Components for attaching the whisker pole to the mast and to the jib sheet may be the same or similar to those used on other embodiments described herein. Upon deflation, the truss can be rolled up or folded and stored in a space that is a fraction of its inflated volume. The large surface area of the inflated truss should not hinder sailing performance because it is most likely used when sailing downwind.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. An inflatable whisker pole for a sailboat comprising:

an elongate inflatable body having first and second ends, the inflatable body consisting essentially of an airtight and watertight material and at least a portion of the inflatable body being flexible and flattenable in a deflated state, and rigid in an inflated state when inflated to an internal pressure of greater than 2 psi;

a valve for providing fluid communication between the interior of the inflatable body and a compatible gas source, the gas source comprising a manual and/or powered pump, or a compressed gas supply;

a first connector affixed to the first end of the inflatable body, the first connector constructed and arranged to attach removably to a headsail or headsail sheet;

a second connector affixed to the second end of the inflatable body, the second connector constructed and arranged to secure to an area that is stationary with respect to the hull of the sailboat; and wherein the elongate inflatable body provides adequate rigidity in an inflated state to maintain position of a headsail or headsail sheet and resists compression exerted by the headsail during operation of the sailboat whereby the whisker pole can maintain its internal pressure and float if lost overboard when in an inflated state.

2. The whisker pole of claim 1 wherein the second connector is constructed and arranged to be secured to the mast.

3. The whisker pole of claim 1 wherein the inflatable body is comprised of PVC coated polyurethane or neoprene-coated nylon.

4. The whisker pole of claim 1 wherein the inflatable body is substantially cylindrical in cross-section.

5. The whisker pole of claim 1 wherein the length of the pole is adjustable.

6. The whisker pole of claim 1 wherein the length of the whisker pole can be adjusted by controlling the volume of gas retained by the inflatable body.

7. The whisker pole of claim 1 wherein the elongate body is comprised of a material selected from the group consisting of polyaramid fiber fabric, PVC, polyurethane, polyester, and nylon.

8. The whisker pole of claim 1 comprising a plurality of inflatable tubes in a truss configuration.

9. The whisker pole of claim 1 comprising a plurality of inflatable tubes aligned axially with each other and connected end-to-end.

10. The whisker pole of claim 1 wherein the inflatable body is greater than one inch in diameter.

* * * * *